US006240863B1

(12) United States Patent
Vickroy et al.

(10) Patent No.: US 6,240,863 B1
(45) Date of Patent: Jun. 5, 2001

(54) EMBROIDERY MACHINE MOUNTING FRAME APPARATUS AND METHOD

(76) Inventors: Bryan K. Vickroy, 6512 192$^{nd}$ Ave. East; David Drost, 21975 SW. 75$^{th}$ Ave., both of Bonny Lake, WA (US) 98390

( * ) Notice: Subject to any disclaimer, the term of this patent is extended or adjusted under 35 U.S.C. 154(b) by 0 days.

(21) Appl. No.: 09/436,905

(22) Filed: Nov. 9, 1999

(Under 37 CFR 1.47)

Related U.S. Application Data

(60) Provisional application No. 60/107,822, filed on Nov. 10, 1998.

(51) Int. Cl.$^{7}$ ..... D05C 09/04

(52) U.S. Cl. ..... 112/475.18; 112/103; 38/102.2

(58) Field of Search ..... 112/103, 475.01, 112/475.18; 38/102.2, 102.91; 156/93; 160/380; 101/127.1

(56) References Cited

U.S. PATENT DOCUMENTS

| | | | | |
|---|---|---|---|---|
| 4,993,333 | * | 2/1991 | Moore, III | 112/103 |
| 5,546,877 | * | 8/1996 | Moore | 112/103 |
| 5,555,828 | | 9/1996 | Rowley . | |
| 5,915,315 | * | 6/1999 | Bentz | 112/103 |
| 6,109,194 | * | 8/2000 | Farb | 112/103 |

OTHER PUBLICATIONS

Informational Brochure regarding "Hoop Station" by E–Z–Hoop.
Informational Brochure regarding "E–Z Hat" by E–Z–Hoop.
Informational Brochure regarding Instructions for E–Z Hat.
Information by Hoop–It–All, Inc. regarding News Release; Press Release; price list; and product review, Oct. 1997.

* cited by examiner

*Primary Examiner*—Ismael Izaguirre
(74) *Attorney, Agent, or Firm*—William G. Forster

(57) ABSTRACT

The invention is a mounting frame 20 configured and arranged for positioning a workpiece 22 in an automated computerized embroidery machine 24. The mounting frame 20 is provided to replace the prior art hoop frame system. The mounting frame 24 supports a workpiece 22 disposed on the adhesive side 34 of the adhesive backing material 32. The mounting frame 24 is formed from sheet metal to include an upper surface 36 having an aperture 38 that extends downward through the mounting frame 24 to a mirror image, opposing lower surface 42 to define an open primary sewing field 40. With this configuration, the lower surface 42 is adapted to receive thereon adhesive backing material 32 oriented so that the adhesive side 34 is facing upward to adhere to the lower surface 42 to cover the primary sewing field 40. In operation, the workpiece 22 is placed within the primary sewing field 40 on the upward facing adhesive side 34 of the adhesive backing material 32 such that the adhesive backing material 32 forms the required backing material for the embroidery operation on the workpiece 22. Additionally, opposing portions of the mounting frame 20 define opposing support arms 48, 50 that engage the support carriage 26 such that the mounting frame 20 is secured thereto during the embroidery operation.

19 Claims, 5 Drawing Sheets

FIG. 3
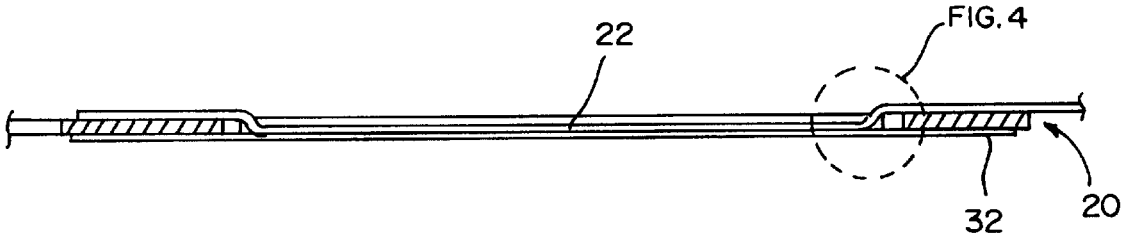
FIG. 4
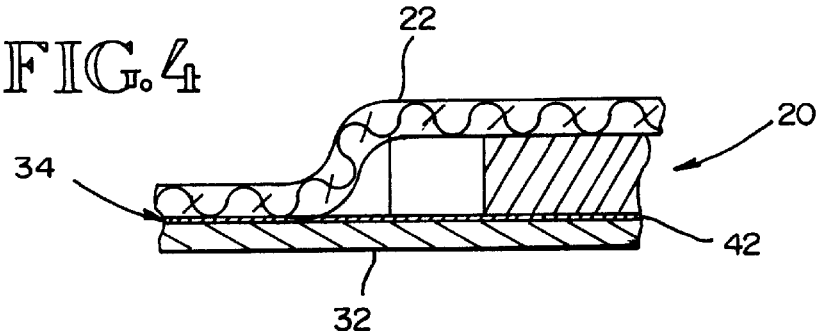
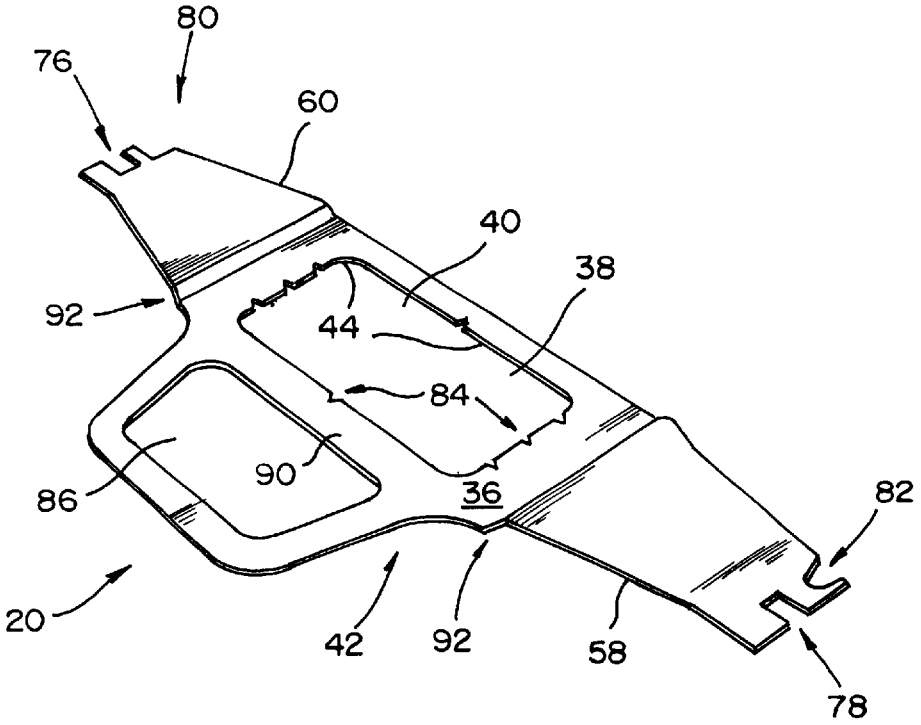
FIG. 5

EMBROIDERY MACHINE MOUNTING FRAME APPARATUS AND METHOD

This application claims the benefit of U.S. Provisional Application Ser. No. 60/107,822 Filed Nov. 10, 1998.

BACKGROUND

This invention relates generally to automatic computerized embroidery machines, and more particularly to apparatus employed to secure and support backing material fabric in position within the embroidery machine during the embroidery operation.

Apparatus directed to secure and support backing material fabric in position within an embroidery machine for the embroidery operation is known in the art. Typically, embroidering is imparted on a workpiece by automated embroidery machines of the type that have a hoop guide or carriage. In the prior art, a workpiece is mounted on any number of hoops, each hoop in turn being mounted on an automatically controlled hoop guide or carriage. The hoop guide moves the hoop relative to the needle of the embroidery machine as the needle introduces stitching to the workpiece. To ensure an accurate embroidery design, especially during mass production, the hoop must hold the backing fabric and attach securely and precisely to the hoop guide/carriage. One such device, that operates in this way, and is provided for this purpose is illustrated in U.S. Pat. No. 5,555,828 issued to Rowley in 1996. The '828 patent is a hoop attachment assembly for mounting an embroidery hoop frame to an automatically controlled hoop guide/carriage of an embroidery machine. Like most hoop based systems, changing the backing fabric for each workpiece is cumbersome and time consuming. In addition, such systems generate substantial quantities of wasted backing material.

Accordingly, a need remains for an apparatus designed to quickly and securely position backing material within a common computerized embroidery machine, wherein the apparatus is adapted to engage the embroidery machine's automatically controlled hoop guide or carriage, for the embroidery operation.

SUMMARY

One object of the present invention is to minimize the amount of wasted backing material in the embroidery operation.

A second object is to reduce the time spent setting up the workpiece for an embroidery operation.

Another object is to increase the production realized in repetitive embroidery operations.

Yet another object is to increase the precision with which embroidery is placed upon a workpiece.

A further object is to simplify the embroidery process.

Still another object is to increase the productivity of embroidery machines.

The invention is a one-piece mounting frame arranged and configured to replace the prior art hoop system typically employed to maintain backing material along with a workpiece in position during the embroidery operation in modern computerized embroidery machines. Modern embroidery machines commonly include a support carriage for supporting such two-piece hoop frames in correct position within the embroidery machine. The present invention mounting frame is provided to replace the prior art hoop frame system and is constructed to secure and support, within an embroidery machine, during the embroidery operation, adhesive backing material that includes at least one adhesive side. Further, the mounting frame supports a workpiece disposed adjacent to, i.e., on the adhesive side of the adhesive backing material.

In the preferred embodiment, the mounting frame is formed from sheet metal to include an upper surface having an aperture that extends downward through the mounting frame to define an open primary sewing field where the needles from the machine perform the embroidery operation. Likewise, a similarly shaped, mirror image, opposing lower surface is formed. Accordingly, the aperture extends downward to the lower surface such that an endless sidewall surface is defined by the aperture between the upper surface and the lower surface. With this configuration, the lower surface is adapted to receive thereon adhesive backing material oriented so that the adhesive side is facing upward to adhere to the lower surface to cover the primary sewing field. Wherein the workpiece is placed within the primary sewing field on the upward facing adhesive side of the adhesive backing material such that the adhesive backing material forms the required backing material for the embroidery operation on the workpiece. Additionally, the mounting frame includes opposing support arms disposed to engage the support carriage such that the mounting frame is secured thereto during the embroidery operation.

In accordance with another aspect of the present invention, the mounting frame comprises a second aperture that extends from the upper surface, through the mounting frame to the lower surface thereby defining a secondary sewing field.

In accordance with still another aspect of the present invention, at least one support arm defines a tooling point for locating the mounting frame in proper position in relation to a tooling pin disposed on the support carriage.

The foregoing and additional objects, features, and advantages of this invention will become more readily apparent from the following detailed description of a preferred embodiment which proceeds with reference to the accompanying drawings. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 3 is a fragmental cross-sectional view taken along line 3—3 showing a mounting frame having adhesive backing material adhered to the bottom surface thereof, and a workpiece disposed in the primary sewing field on the adhesive backing material.

FIG. 4 is an enlarged view of a portion of FIG. 3 encircled by a broken line.

FIG. 5 is a top side perspective view illustrating a mounting frame having two sewing fields wherein the support arms have a plurality of tooling points for engagement with a plurality of varying tooling pin arrangements of varying embroidering machines.

DETAILED DESCRIPTION OF PREFERRED EMBODIMENT

Figure 1:
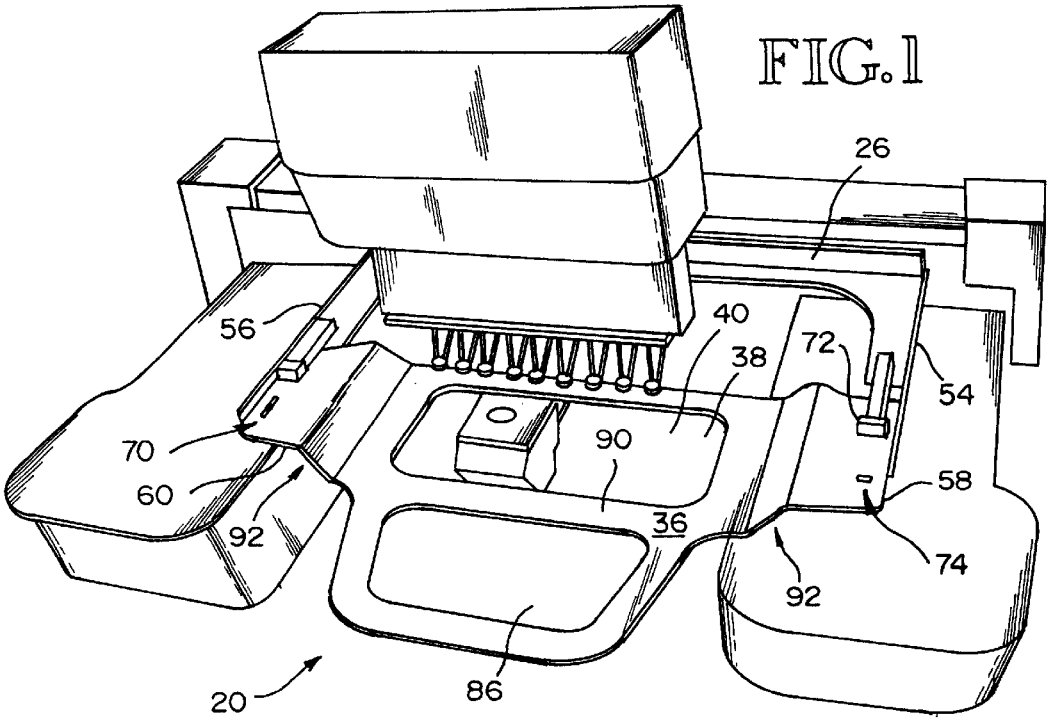
FIG. 1 is a front side perspective view of an automated computerized embroidery machine having a movable support carriage.

The invention is a mounting frame 20 configured and arranged for positioning a workpiece 22 in an automated computerized embroidery machine 24. Modern embroidery machines of this type commonly include a support carriage 26 for supporting a typical two-piece hoop frame 28 that maintains a workpiece 22 and backing material 30 in correct position within the embroidery machine 24. The mounting frame 20 is provided to replace the prior art hoop frame system and is constructed to secure and support, within an embroidery machine 24, during the embroidery operation, adhesive backing material 32 that includes at least one adhesive side 34. Further, the mounting frame 24 supports a workpiece 22 disposed adjacent to, i.e., on the adhesive side 34 of the adhesive backing material 32.

In the preferred embodiment, the mounting frame 24 is formed from sheet metal to include an upper surface 36 having an aperture 38 that extends downward through the mounting frame 24 to define an open primary sewing field 40 where the needles (not illustrated) from the embroidery machine perform the embroidery operation. Likewise, a similarly shaped, mirror image, opposing lower surface 42 is formed. Accordingly, the aperture 38 extends downward to the lower surface 42 such that an endless sidewall 44 is defined by the aperture 38 between the upper surface 36 and the lower surface 42.

With this configuration, the lower surface 42 is adapted to receive thereon adhesive backing material 32 oriented so that the adhesive side 34 is facing upward to adhere to the lower surface 42 to cover the primary sewing field 40. Wherein the workpiece 22 is placed within the primary sewing field 40 on the upward facing adhesive side 34 of the adhesive backing material 32 such that the adhesive backing material 32 forms the required backing material for the embroidery operation on the workpiece 22. As will be discussed more fully below, opposing portions of the mounting frame 20 define opposing support arms 48, 50 that engage the support carriage 26 such that the mounting frame 20 is secured thereto during the embroidery operation.

Figure 8:
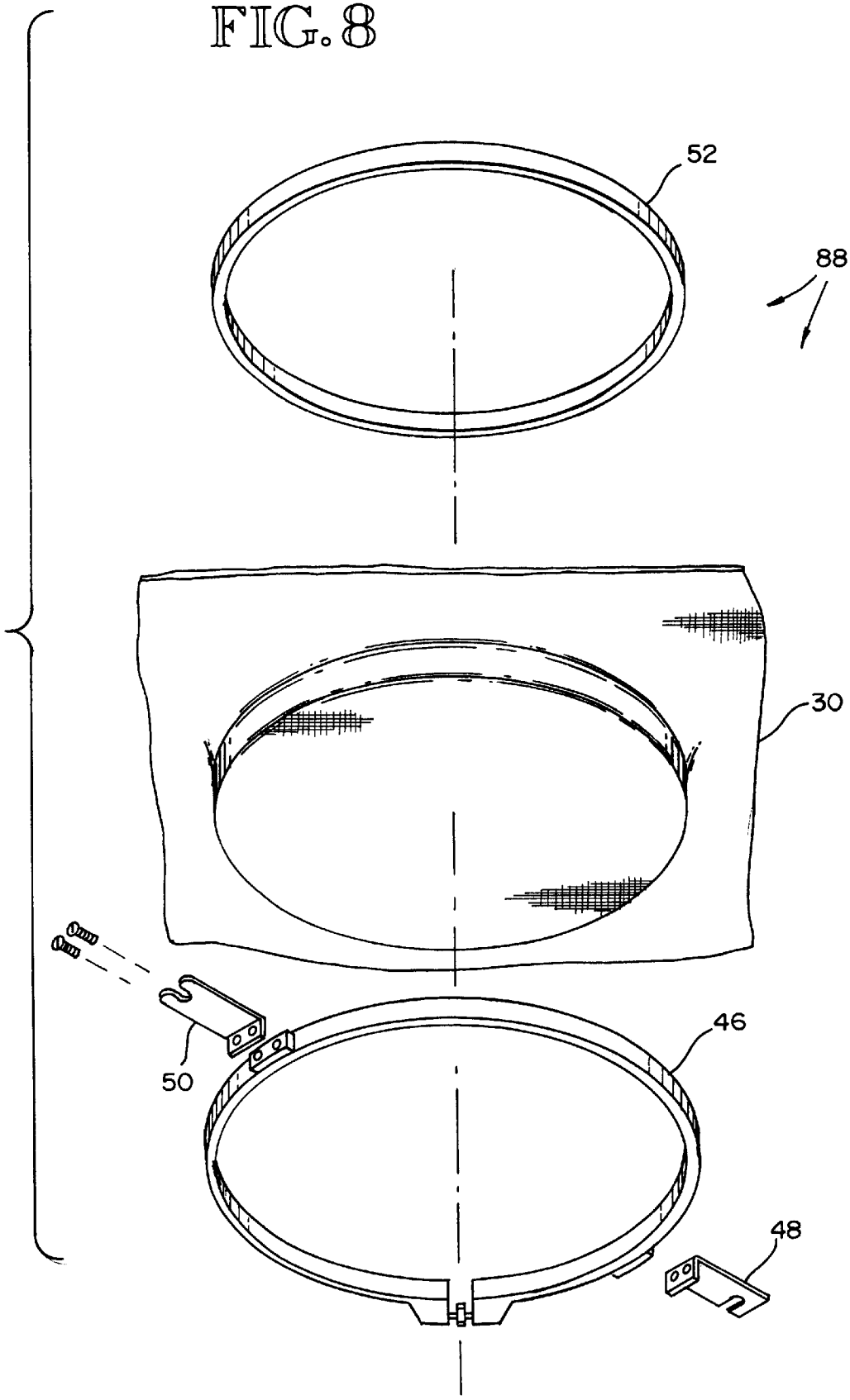
FIG. 8 is an exploded view of a prior art hoop system widely employed in automatic embroidery machines for supporting embroidery backing material and a workpiece (not illustrated).

Directing attention to FIG. 8, a prior art two-piece hoop frame 28 is illustrated. As can be seen, the hoop frame 28 comprises a large diameter hoop 46 that includes support arms 48, 50. Support arms 48, 50 are provided to engage a support carriage 26 to secure the hoop frame 28 thereto (not illustrated). Also included is a reduced diameter hoop 52 that is sized to closely fit within the large diameter hoop 46 such that backing material 30 can be held in place therebetween. In this way, by securing the large diameter hoop 46 to the support carriage 26, the backing material 30 is similarly secured in proper position, within the support carriage 26 for the embroidery operation on a work piece (not illustrated in FIG. 8) that is placed on the backing material 30.

As can be seen, a hoop frame 28, constructed as noted above, requires multiple steps to prepare the same for an embroidery operation. Indeed, each article/workpiece to be embroidered requires the user to place a new piece of backing material 30 within the hoop frame 28. Accordingly, embroidery of multiple articles is cumbersome and requires the user to consume a large amount of time preparing the hoop frame 28 between embroidery operations.

In contrast, the present invention mounting frame 20 is constructed to receive adhesive backing material 32 that can easily be applied to the mounting frame 20 for an embroidery operation, and easily peeled off following the embroidery operation. Accordingly, the set-up/preparation time between embroidery operations is greatly reduced with the present invention mounting frame 20.

Considering now in more detail the structure of a mounting frame 20, the preferred embodiment thereof is monolithically constructed from stainless steel sheet metal. Although stainless steel is employed in the preferred embodiment, many other materials could be used with equally suitable results. Typically, most modern computerized embroidery machines have a support carriage 26 that includes opposing receiving arms 54, 56 disposed and configured to respectively receive opposing support arms 58, 60 of a mounting frame 20. It should be noted that support arms 58, 60 are integral "portions" of the mounting frame 20.

In order to precisely secure the mounting frame 20 to the support carriage 26 a tooling pin 62 is typically provided on the support surface 66 of each receiving arm 54, 56. Tooling pins are so provided to define reference points on each receiving arm 58, 60 for precise placement of the mounting frame 20 in relation to the support carriage 26. For this purpose tooling points 68, 70 are defined on the support arms 58, 60 by removing a portion thereof to create an aperture or void configured to snugly engage the corresponding tooling pin such that relative movement between the mounting frame 20 and the support carriage 26 is prevented. Further, some embroidery machines include a retaining spring clamp 72 that applies a biasing pressure to bias the mounting frame 20 toward the receiving arms 54, 56 to maintain the mounting frame 20 in proper position.

Figure 2:
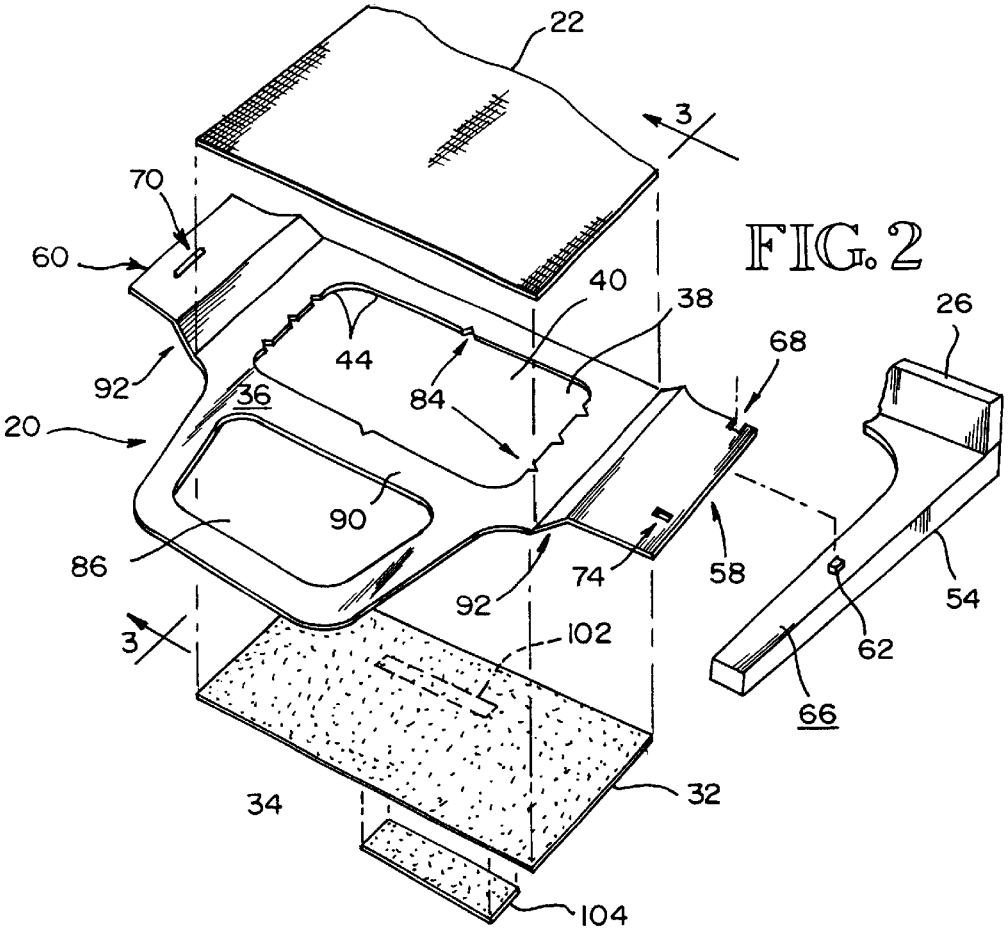
FIG. 2 is an exploded perspective view of a mounting frame with adhesive backing material disposed below the primary sewing field and a workpiece disposed above the sewing field.
Figure 6:
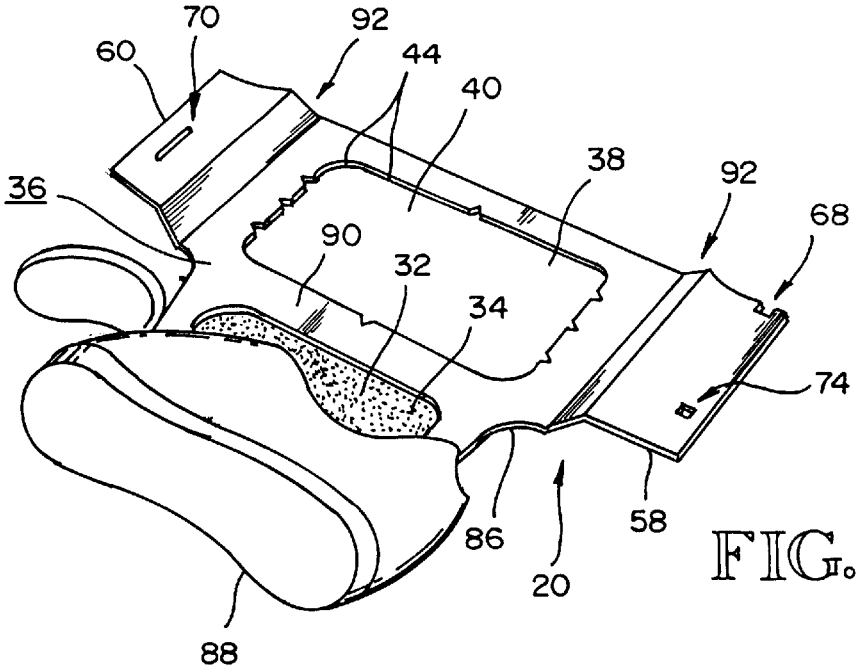
FIG. 6 is a perspective view showing a shoe positioned over the secondary sewing field so that embroidery can be placed on a side of the shoe.

Additionally, as seen in FIGS. 2, 5 and 6 each mounting frame 20 can have multiple sets of tooling points so that one mounting frame 20 can be employed with multiple embroidery machines that have varying placements of tooling pins. For example, in FIG. 5 tooling points 76, 78, 80 and 82 are illustrated to show how tooling points might be arranged for use with more than one type of embroidery machine. In this way, the costs associated with manufacturing and using mounting frames is reduced.

In order to properly place a workpiece 22 within a primary sewing field 40 a plurality of reference notches 84 are formed in the sidewall 44. The notches 84 are disposed in pairs, one opposing another, to form a grid where any portion of the sewing field 40 can be easily located for placement of a workpiece 22.

Turning again to FIGS. 2, 5 and 6, the preferred embodiment mounting frame 20 includes a secondary sewing field 86. A secondary sewing field 86 is so provided to improve the versatility of the mounting frame 20. For example, FIG. 6 illustrates how the side of a shoe 88 can be embroidered by placing the same over secondary sewing field 86. For this purpose, secondary sewing field 86 extends outward "cantilevering" from the mounting frame 20.

In order to define each sewing field, a integrally formed partition separator 90 is disposed between primary sewing field 40 and secondary sewing field 86. In addition, the partition separator 90 provides a mounting surface for the adhesive backing material 32 so that smaller width, less expensive rolls of backing material can be employed.

Importantly, it should be understood that most modern embroidery machines require that the backing material be positioned at a lower elevation than the support surface of the support arms. Accordingly, as best seen in FIGS. 2, 5 and 6, the sewing field portion of the mounting frame 20 is recessed. For this purpose, a step 92 is provided. In the present invention, Step 92 is formed by creating a 45 degree bend in the mounting frame 20 to either side of primary sewing field 40. As a result, the support arms 58, 60 are raised above the primary sewing field 40. Although the step provided in the preferred embodiment is 45 degrees, other degrees of slope could be equally employed.

In operation of an embroidery machine 24 with mounting frame 20, the user first cuts and places adhesive backing material 32 on the lower surface 42. The mounting frame 20 is then properly positioned on the support carriage 26 according to each tooling pin 62. Then a workpiece 22 is positioned on the adhesive backing material 32. The programmed embroidery machine then proceeds through the embroidery process. After the embroidery process is completed, the workpiece 22 is pulled away from the adhesive backing material 32 thereby removing a piece thereof. The removal creates a hole 102 in the backing material.

Importantly, an advantage of using adhesive backing material 32 is that a patch 104, constructed of scrap adhesive backing material, can be placed over hole 102 so that an additional embroidery cycle can be performed. Such "patching" can be executed multiple times. Accordingly, cost savings is realized by not having to replace the whole piece of adhesive backing material 32 after each embroidery operation.

Attention is directed to FIGS. 3 and 4 for a more detailed illustration of the relationship of the adhesive backing material 32 and the workpiece 22 to the mounting frame 20. As can be seen, the adhesive side 34 of the adhesive backing material 32 is flush with the lower surface 42.

Figure 7:
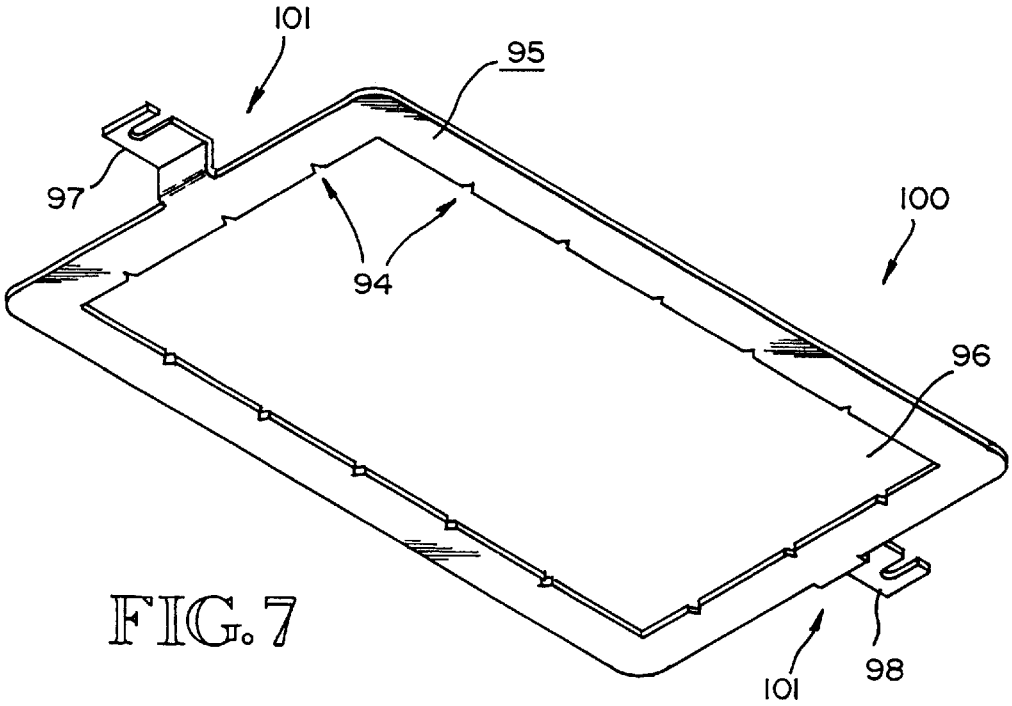
FIG. 7 is a alternate embodiment of a mounting frame arranged to be received by an embroidery machine.

Turning now to FIG. 7, an alternate embodiment mounting frame 100 is illustrated. Such an alternate embodiment is provided so that older embroidery machines (not illustrated) can be retrofitted fitted with a mounting frame adapted to receive adhesive backing material 32. Similar to the preferred embodiment, the alternate embodiment mounting frame 100 comprises alignment notches 94 disposed between an upper surface 95 and a lower surface (not illustrated). Additionally, a sewing field 96 is disposed between support arms 97, 98 which are configured to define a step 101.

Figure 9:
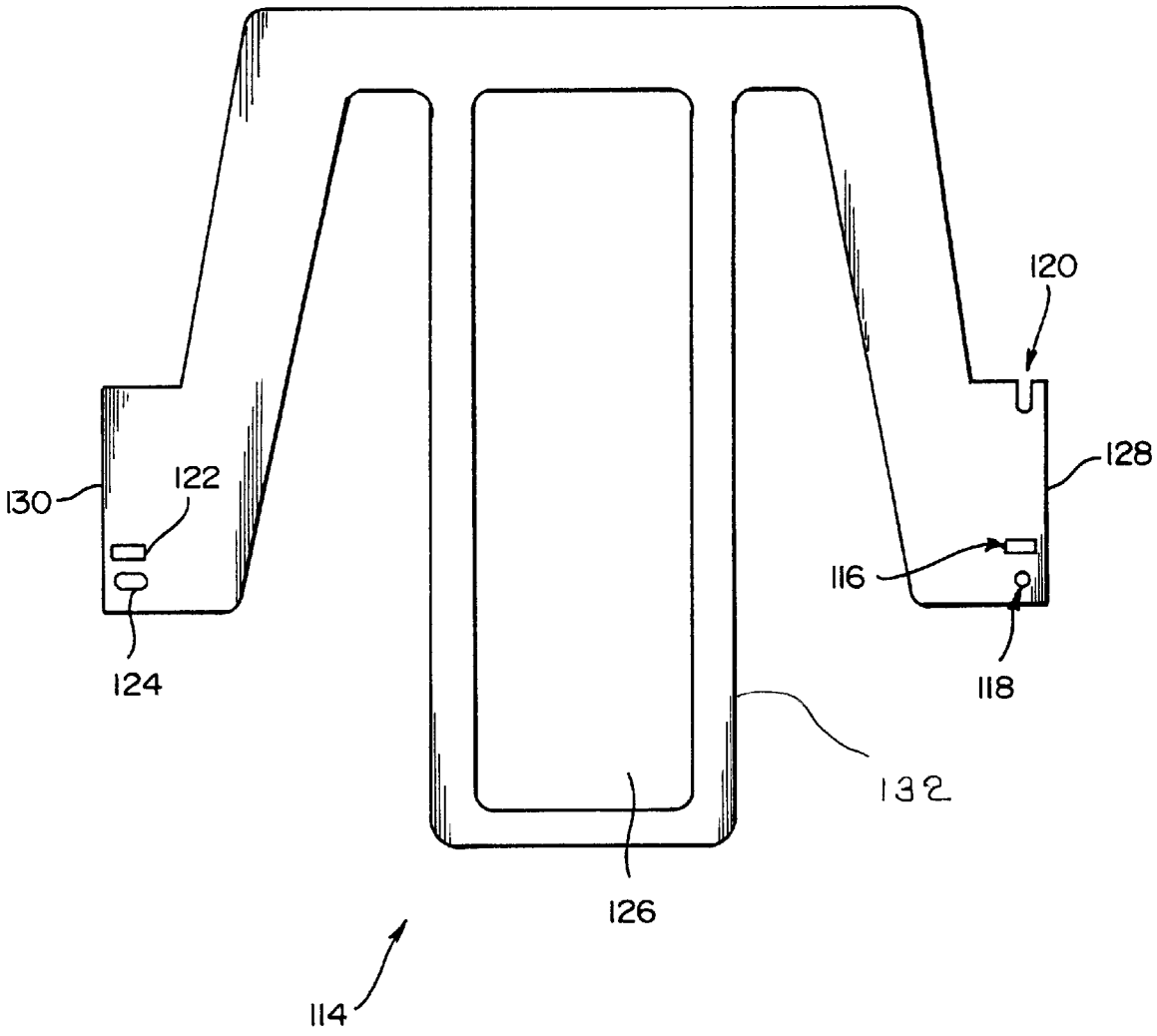
FIG. 9 is an alternate embodiment of a mounting frame wherein the primary sewing field is defined by a portion of the mounting frame that cantilevers outward, between the support arms so that a workpiece (not illustrated) can be disposed between the support arms, unobstructed around the cantilevered portion of the mounting frame that defines the sewing field.

Directing attention to FIG. 9, an additional alternate embodiment mounting frame 114 is illustrated. Importantly, mounting frame 114 is configured so that a workpiece (not illustrated) can be disposed between the support arms 128, 130 in a way allowing the workpiece to be disposed between the support arms 128, 130 "unobstructed" around the cantilevered portion 132 of the mounting frame 114 that defines the sewing field 126. More specifically, a workpiece, such as a sleeve (not illustrated), could be received over the cantilevered portion 132 to cover a sewing field 126 that lies directly between the support arms 128, 130. In this way, a sleeve, pant leg, or any other such structure, is easily positioned over sewing field 126.

Having illustrated and described the principles of my invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A one-piece mounting frame arranged and configured for positioning a workpiece in an automated computerized embroidery machine of the type having a support carriage with tooling pins for supporting and precisely locating thereon a common two-piece hoop frame that maintains a workpiece and backing material in correct position within the embroidery machine, the mounting frame being constructed to secure and support, within an embroidery machine during the embroidery operation, adhesive backing material that includes at least one adhesive side, and a workpiece disposed adjacent to the adhesive side of the backing material, the mounting frame comprising:

an upper surface having an aperture that extends downward through the mounting frame to define a primary sewing field;

a similarly shaped, mirror image, opposing lower surface, the aperture extending downward to the lower surface such that an endless sidewall surface is defined by the aperture between the upper surface and the lower surface, the lower surface adapted to receive thereon adhesive backing material oriented so that the adhesive side is facing upward to adhere to the lower surface to cover the primary sewing field, wherein the workpiece is placed within the primary sewing field on the upward facing adhesive side of the adhesive backing material such that the adhesive backing material forms the required backing material for the embroidery operation on the workpiece; and wherein the mounting frame includes opposing support arms disposed to engage the support carriage such that the mounting frame is secured thereto during the embroidery operation.

2. A mounting frame as recited in claim 1 wherein the primary sewing field is defined by a portion of the mounting frame that cantilevers outward, between the support arms so that a workpiece can be disposed between the support arms, unobstructed around the cantilevered portion of the mounting frame that defines the sewing field.

3. A mounting frame as recited in claim 1 wherein at least one support arm defines a tooling point for locating the mounting frame in proper position in relation to a tooling pin disposed on the support carriage.

4. A mounting frame as recited in claim 3 wherein the tooling point is defined by an opening disposed on a portion of the support arm.

5. A mounting frame as recited in claim 1 further comprising a plurality of reference notches disposed on the endless sidewall surface for creating a grid to aid the user in positioning the workpiece on the adhesive backing.

6. A mounting frame as recited in claim 1 further comprising a second aperture that extends from the upper surface, through the mounting frame to the lower surface thereby defining a secondary sewing field.

7. A mounting frame as recited in claim 1 wherein opposite portions of the mounting frame, adjacent the aperture, are recessed to form a step disposed between each support arm and the primary sewing field for positioning the adhesive backing material vertically in relation to the embroidery machine.

8. A mounting frame as recited in claim 1 wherein the primary sewing field is stepped down from the elevation support arms.

9. A one-piece mounting frame arranged and configured for positioning a workpiece in an automated computerized embroidery machine of the type having a support carriage with tooling pins for supporting and precisely locating thereon a common two-piece hoop frame that maintains a workpiece and backing material in correct position within the embroidery machine, the mounting frame being constructed to secure and support, within an embroidery machine during the embroidery operation, adhesive backing material that includes at least one adhesive side, and a workpiece disposed adjacent to the adhesive side of the backing material, the mounting frame comprising:

an upper surface having an aperture that extends downward through the mounting frame to define a primary sewing field;

a similarly shaped, mirror image, opposing lower surface, the aperture extending downward to the lower surface such that an endless sidewall surface is defined by the aperture between the upper surface and the lower surface, the lower surface adapted to receive thereon adhesive backing material oriented so that the adhesive side is facing upward to adhere to the lower surface to cover the primary sewing field, wherein the workpiece is placed within the primary sewing field on the upward facing adhesive side of the adhesive backing material such that the adhesive backing material forms the required backing material for the embroidery operation on the workpiece;

opposing support arms disposed to engage the support carriage such that the mounting frame is secured thereto during the embroidery operation; and wherein the mounting frame further comprises a second aperture that extends from the upper surface, through the mounting frame to the lower surface thereby defining a secondary sewing field adjacently disposed to the primary sewing field.

10. A mounting frame as recited in claim 9 wherein at least one support arm defines a tooling point for locating the mounting frame in proper position in relation to a tooling pin disposed on the support carriage.

11. A mounting frame as recited in claim 10 wherein the tooling point is defined by an opening disposed on a portion of the support arm.

12. A mounting frame as recited in claim 9 further comprising a plurality of reference notches disposed on the endless sidewall surface for creating a grid to aid the user in positioning the workpiece on the adhesive backing.

13. A mounting frame as recited in claim 9 wherein opposite portions of the mounting frame, adjacent the aperture, are recessed to form a step disposed between each support arm and the primary sewing field for positioning the adhesive backing material vertically in relation to the embroidery machine.

14. A mounting frame as recited in claim 9 wherein the primary sewing field is stepped down from the elevation support arms.

15. A method of making a one-piece mounting frame for positioning a workpiece in an automated computerized embroidery machine of the type having a support carriage with tooling pins for supporting and precisely locating thereon a common two-piece hoop frame that maintains a workpiece and backing material in correct position within the embroidery machine, the mounting frame being constructed to secure and support, within an embroidery machine during the embroidery operation, adhesive backing material that includes at least one adhesive side, and a workpiece disposed adjacent to the adhesive side of the backing material, the method comprising the steps:

forming an upper surface to include an aperture that extends downward through the mounting frame to define a primary sewing field;

forming a similarly shaped, mirror image, opposing lower surface, the aperture extending downward to the lower surface such that an endless sidewall surface is defined by the aperture between the upper surface and the lower surface, the lower surface adapted to receive thereon adhesive backing material oriented so that the adhesive side is facing upward to adhere to the lower surface to cover the primary sewing field, wherein the workpiece is placed within the primary sewing field on the upward facing adhesive side of the adhesive backing material such that the adhesive backing material forms the required backing material for the embroidery operation on the workpiece; and forming opposing mounting arms disposed to engage the support carriage such that the mounting frame is secured thereto during the embroidery operation.

16. A method of making a one-piece mounting frame as recited in claim 15 wherein the primary sewing field is formed by a portion of the mounting frame that cantilevers outward, between the support arms so that a workpiece can be disposed between the support arms, unobstructed around the cantilevered portion of the mounting frame that defines the sewing field.

17. A method of making a one-piece mounting frame as recited in claim 15 further comprises the step of forming a tooling point on at least one support arm for locating the mounting frame in proper position in relation to a tooling pin disposed on the support carriage.

18. A method of making a one-piece mounting frame as recited in claim 15 further comprising the step of forming a second aperture that extends from the upper surface, through the mounting frame to the lower surface thereby defining a secondary sewing field.

19. A method of making a one-piece mounting frame as recited in claim 15 further comprising the step of recessing opposite portions of the mounting frame, adjacent the aperture, to form a step disposed between each support arm and the primary sewing field for positioning the adhesive backing material vertically in relation to the embroidery machine.

* * * * *